United States Patent [19]

Custer

[11] 4,398,510

[45] Aug. 16, 1983

[54] TIMING MECHANISM FOR ENGINE BRAKE

[75] Inventor: Dennis R. Custer, West Granby, Conn.

[73] Assignee: The Jacobs Manufacturing Company, Bloomfield, Conn.

[21] Appl. No.: 248,344

[22] Filed: Mar. 27, 1981

Related U.S. Application Data

[63] Continuation-in-part of Ser. No. 958,119, Nov. 6, 1978, abandoned.

[51] Int. Cl.[3] ..... F02D 13/04

[52] U.S. Cl. ..... 123/90.16; 123/321; 123/198 DB

[58] Field of Search ..... 123/90.12, 90.16, 97 B, 123/90.55, 90.15, 113, 116, 90.11, 90.13, 198 DB, 320, 321, 322

[56] References Cited

U.S. PATENT DOCUMENTS

| | | | |
|---|---|---|---|
| 2,051,232 | 8/1936 | Voorhies | 123/90 |
| 2,116,749 | 5/1938 | Daisley | 123/90 |
| 2,237,854 | 4/1941 | Voorhies | 123/90 |
| 2,599,886 | 6/1952 | Bergmann | 123/90 |
| 2,645,215 | 7/1953 | Moser | 123/90 |
| 2,784,706 | 3/1957 | Humphreys | 123/90 |
| 3,304,925 | 2/1968 | Rhoads | 123/90.55 |
| 3,405,699 | 10/1968 | Laas | 123/97 B |
| 3,542,001 | 11/1970 | Line | 123/90.55 |
| 3,786,792 | 1/1974 | Pelizzoni | 123/321 |
| 3,809,033 | 5/1974 | Cartledge | 123/97 B |
| 4,150,640 | 4/1979 | Egan | 123/90.12 |
| 4,158,348 | 6/1979 | Mason | 123/321 |
| 4,249,489 | 2/1981 | Bruder | 123/90.16 |
| 4,271,796 | 6/1981 | Sickler | 123/321 |

*Primary Examiner*—Charles J. Myhre
*Assistant Examiner*—Carl Stuart Miller
*Attorney, Agent, or Firm*—Donald E. Degling

[57] ABSTRACT

Hydro-mechanical brake timing means are provided to control the timing of an engine braking system of the gas compression type for an internal combustion engine wherein the engine braking system includes a hydro-mechanical mechanism which opens the exhaust valve near the top of the compression stroke of the engine so that the energy absorbed by the engine during the compression stroke is not returned to the engine during the expansion stroke. In accordance with the present invention, hydro-mechanical means are provided in the exhaust valve actuating mechanism whereby the clearance in that mechanism is reduced to a value which maximizes the retarding power developed by the engine whenever the engine brake is activated.

12 Claims, 4 Drawing Figures

FIG. 1
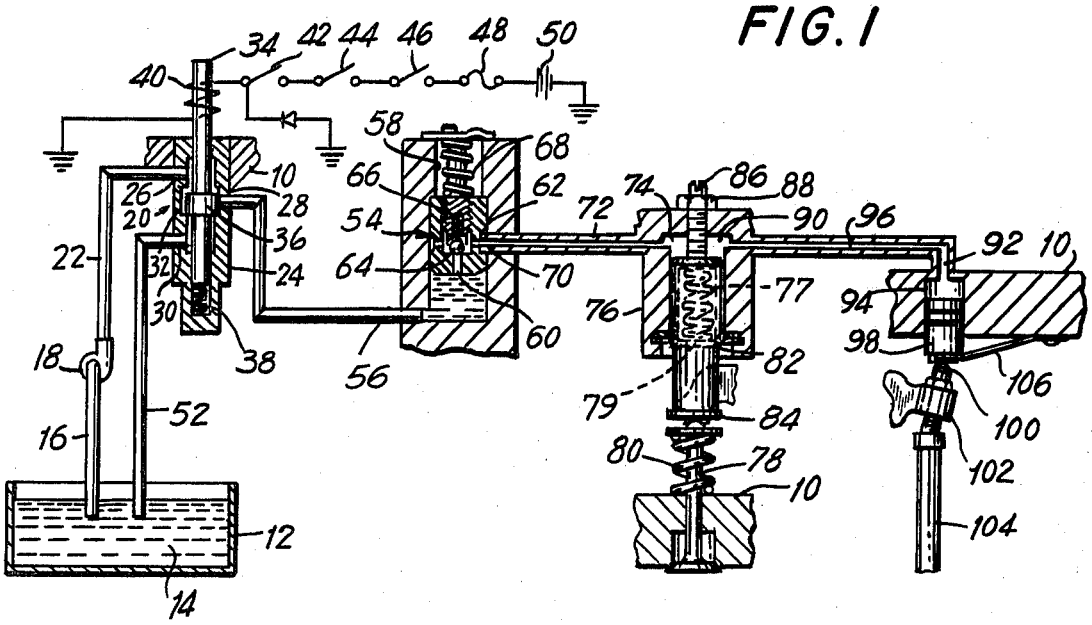
FIG. 2
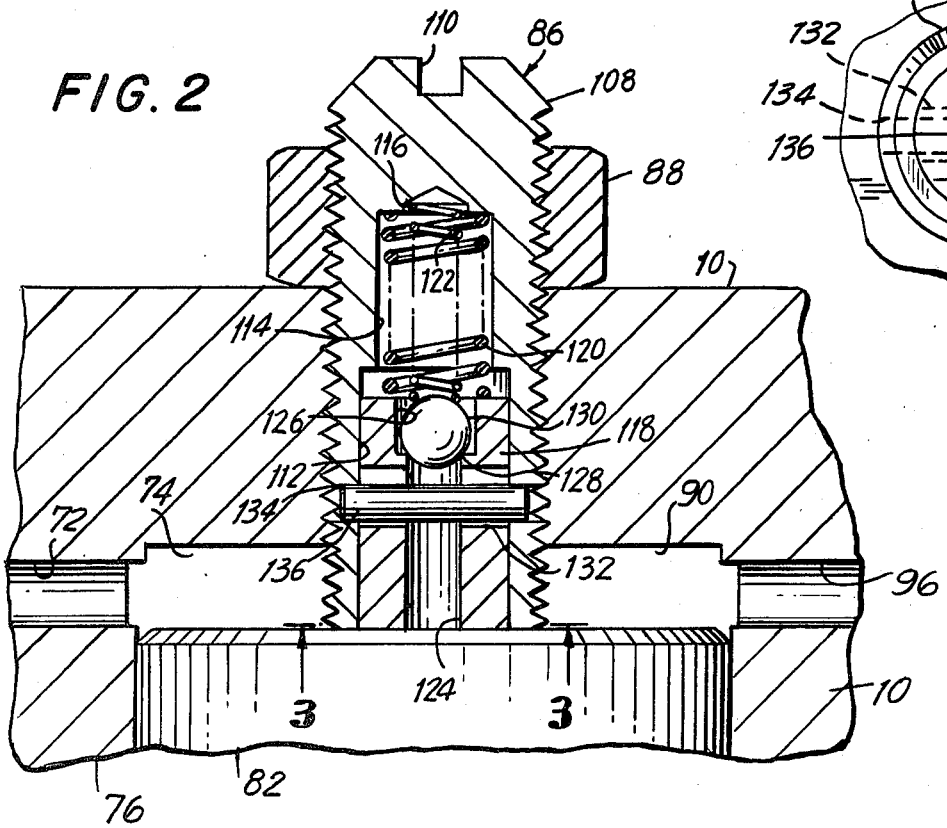
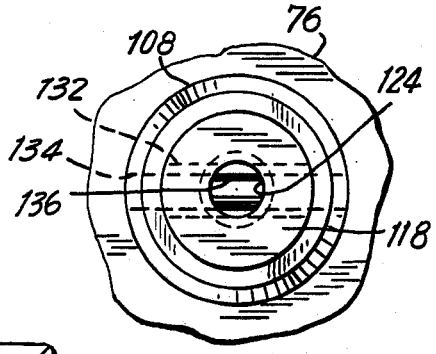
FIG. 3

TIMING MECHANISM FOR ENGINE BRAKE

BACKGROUND OF THE INVENTION

This application is a continuation-in-part of application Ser. No. 958,119 now abandoned, filed Nov. 6, 1978.

FIELD OF THE INVENTION

This invention relates generally to the field of engine brakes or engine retarders and more particularly to engine brakes wherein the exhaust valves of the engine are opened near the top of the compression stroke of the engine so that the energy absorbed by the engine during the compression stroke is not returned to the engine during the expansion stroke. Such an engine brake is known as a compression release engine brake. The present invention relates specifically to a timing mechanism for an engine brake of the above type.

PRIOR ART

For many years it has been recognized that the ordinary wheel braking mechanisms, commonly of the disc or drum type fitted to commercial vehicles, while capable of absorbing a large amount of energy during a short period, are incapable of absorbing the lesser amounts of energy over an extended period of time which may be required, for example, during descent of a long decline. In such circumstances, the friction material used in the brake mechanism will become overheated (causing "brake fading") and may be destroyed while the metallic parts may warp or buckle. In general, the problem has been resolved either by using a lower gear ratio so that the engine can function more effectively as a brake due to its inherent friction or by employing some form of auxiliary braking system. A number of such auxiliary braking systems, generally known as engine retarders, have been developed by the art, including hydrokinetic retarders, exhaust brakes, electric brakes, and engine brakes. In each of these systems, a portion of the kinetic energy of the vehicle is transformed into heat as a result of gas compression, fluid friction, or electrical resistance and, thereafter dissipated to the atmosphere directly or through the exhaust or cooling system. The common characteristic of such auxiliary braking systems is the ability to absorb and dissipate a certain amount of power continuously or at least for an indefinite period of time. Each of the types of engine retarder referred to above is described in detail in the publication "Retarders for Commercial Vehicles," published in 1975 by Mechanical Engineering Publications Limited, London, England.

The hydrokinetic and electric retarders are generally quite heavy and bulky since they require turbine or dynamo mechanisms and thus may be undesirable from the viewpoint of initial cost as well as operating cost. The exhaust brake, while generally simple and compact, necessarily increases the exhaust manifold pressure and may occasion "floating" of the exhaust valves of the engine, a generally undesirable condition.

It has long been recognized that in the ordinary operation of an internal combustion engine employing the Otto or the Diesel cycle, for example, a considerable amount of work is done during the compression stroke upon the air or air/fuel mixture introduced into the cylinders. During the expansion or power stroke of the engine the work of compression is recovered so that, neglecting friction loses, the net work due to compression and expansion is zero and the net power output is that resulting from the combustion of the fuel/air mixture. When the throttle is closed, or the fuel supply interrupted, the engine will, of course, function as a brake to the extent of the friction inherent in the engine mechanism.

Many attempts have been made to increase the braking power of an engine by converting the engine to an air compressor and dumping the compressed air through the exhaust system. A simple and practical method of accomplishing this end is disclosed in Cummins U.S. Pat. No. 3,220,392. In that patent an auxiliary exhaust valve actuating means synchronized with the engine crankshaft is provided which opens the exhaust valve near the end of the compression stroke, without interfering with the normal actuating cam means for the exhaust valve, together with appropriate control means for the auxiliary exhaust valve actuating means. While the engine brake means set forth in detail in the Cummins U.S. Pat. No. 3,220,392 is capable of producing a retarding power approaching the driving power of the engine under normal operating conditions, experience with this mechanism has revealed that the retarding power may be affected significantly by the timing of the opening of the engine exhaust valve.

If the exhaust valve is opened too late a significant portion of the retarding power may be lost due to the expansion of the compressed air during the initial part of the expansion stroke. On the other hand, if the exhaust valve is opened too early, there may be insufficient compression during the compression stroke which, similarly, will reduce the amount of retarding power that can be developed.

The timing of the exhaust valve opening is affected to a significant degree by the temperature conditions in the engine which vary as a result of changes in ambient conditions as well as changes in operating conditions. It will be appreciated, for example, that the length of the engine exhaust valve will increase with increases in temperature, thereby reducing the clearances in the valve actuating mechanism. While it is known to provide adjustable elements in the valve actuating mechanism by means of which the clearance may be set (see, for example, U.S. Pat. No. 3,220,392, FIG. 2, element 301), the clearance as determined by the rocker arm adjusting screw (or equivalent element) must be at least large enough when the engine is cold so that some clearance will remain when the engine is hot. If there is inadequate clearance when the engine is hot, the exhaust valve may be held in a partially open condition. In this circumstance, the operation of the engine may be affected adversely and the exhaust valves are apt to be burned. To avoid such effects, it is common to provide a clearance on the order of 0.018 inch in the exhaust valve actuating mechanism.

SUMMARY OF THE INVENTION

As pointed out above, it is necessary to provide a clearance in the actuating mechanisms for the exhaust (and intake) valves of an internal combustion engine so as to compensate for dimensional changes in the mechanism resulting from temperature variations. However, where, as in the compression relief type of engine brake, the exhaust valve actuating mechanism is used additionally as part of an engine brake mechanism, it is highly advantageous to control the clearance or backlash in the valve actuating mechanism to provide a precise control of the valve timing whereby the retarding power of the engine is maximized. In accordance with the present invention, hydro-mechanical means are provided in the exhaust valve actuating mechanism whereby the clearance is reduced to a value maximizing the performance whenever the engine brake is activated. By so reducing the clearance, the exhaust valve is opened sooner and the timing of the valve opening coincides more nearly with the activation of the engine brake master piston so as to maximize the retarding power developed by the engine.

An additional advantage resulting from the present invention is that the maximum pushrod load may be decreased. The pushrod load is caused by the force required to open the exhaust valve against the pressure of the air compressed during the compression cycle and the force required to actuate the fuel injector. By effectively decreasing the clearance in the valve actuating mechanism the timing of the exhaust valve opening is advanced so as to increase the time interval between brake actuation load and the injector actuation load, and thereby minimize the combined effect of the two events. Moreover, by advancing the timing of the exhaust valve opening, the peak engine cylinder pressure may be reduced which also serves to reduce pushrod load.

In certain engines, the design of the intake or exhaust valve pushrods or injector pushrods may be such that the maximum pushrod load induced when the engine brake is in operation may not safely be tolerated. To accommodate such a contingency, it may be desired to provide a negative clearance in the exhaust valve operating mechanism during the engine braking mode of operation so that the exhaust valves will not close fully, thereby limiting the load imposed on the pushrods. Of course, during the fueling mode of engine operation, a positive clearance is required to avoid damage, such as burning, to the valves.

It is, therefore, the primary object of the present invention to provide a predetermined negative or positive clearance in the engine valve operating mechanism whenever the engine is operating in the braking mode while automatically reinstating the normal design clearance in the engine valve operating mechanism when the engine returns to the fueling mode of operation.

DESCRIPTION OF THE DRAWINGS

Further objects and advantages of the invention will become apparent from the following detailed description of the invention and the accompanying drawings in which:

FIG. 1 is a schematic view of an engine brake incorporating the timing advance mechanism according to the present invention;

FIG. 2 is an enlarged fragmentary cross-section of a portion of the engine brake mechanism shown in FIG. 1 showing the timing mechanism of the present invention in more detail;

FIG. 3 is a bottom plan view taken along line 3—3 of FIG. 2.

DETAILED DESCRIPTION OF THE INVENTION

Figure 4:
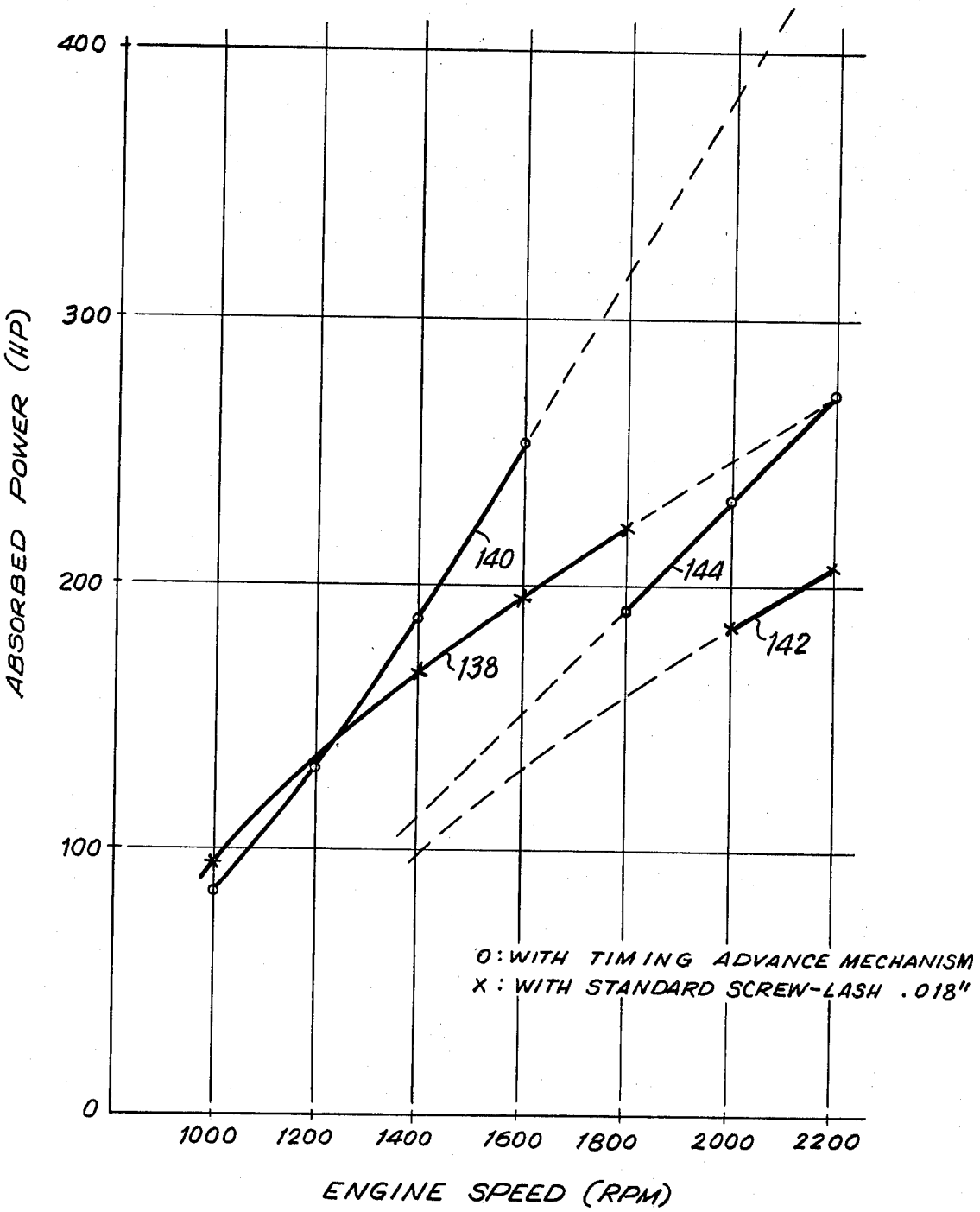
FIG. 4 is a graph showing a comparison of the retarding power developed by two engines incorporating the timing advance mechanism of the present invention and the same two engines without the inventive device.

Referring to FIG. 1, the numeral 10 describes various fragmentary portions of the engine brake housing while 12 is a schematic view of the engine sump containing oil 14. Oil 14 may be withdrawn from the sump 12 through a duct 16 by an oil pump 18 and then directed into a solenoid valve 20 via duct 22. The solenoid valve 20 comprises a valve body 24 secured to the engine brake housing 10, having an inlet port 26, an outlet port 28 and a dump port 30. The inlet port 26 and dump port 30 communicate with the valve cavity 32 respectively at the upper and lower ends thereof while the outlet port 28 communicates with an enlarged central portion of the valve cavity 32. A valve stem 34 is journalled for reciprocating movement within the valve body 24 and carries a cylindrical valve seat 36 adapted to seat against the shoulders formed by the enlarged central portion of the valve cavity 32. A spring 38 normally biases the valve stem 34 so as to prevent the flow of oil from the inlet port 26 to the outlet port 28 of the solenoid valve.

A solenoid coil 40 surrounding the upper end of the valve stem 34 is designed to open the solenoid valve 20 against the bias of the spring 38 whenever electrical current flows through the coil. The solenoid coil circuit includes, in series, a fuel pump switch 42, a clutch switch 44, a dash switch 46, a fuse 48 and the vehicle battery 50. The purpose of each of the logic switches 42, 44 and 46 will be set forth in connection with an explanation of the operation of the engine brake.

The dump port 30 communicates through a duct 52 with the engine sump 12 while the outlet port 28 communicates with a control valve 54 through a duct 56. The control valve 54 is generally in the form of a piston mounted for reciprocating motion within a control valve cylinder 58 formed in the engine brake housing 10. The control valve contains an inlet port 60 which communicates with an outlet port 62. The control valve inlet port 60 is normally closed by a ball check valve 64 biased by a valve spring 66.

When the solenoid valve 20 is in the open position as shown in FIG. 1, oil 14 from the sump 12 flows through the solenoid valve 20 and the outlet duct 56 to the inlet port 60 of the control valve 54. The oil then lifts the control valve 54 against the bias of a control valve spring 68 until the annular outlet port 62 registers with the control valve cylinder outlet port 70. Thereafter the pressure of the oil opens the check valve 64 permitting oil to pass through the control valve 54 and into the duct 72 which communicates between the outlet port 70 of the control valve and the inlet port 74 to the slave cylinder 76.

The slave cylinder 76 is formed in the engine brake housing 10 so as to be aligned with an exhaust valve 78 which is biased to a closed position by an exhaust valve spring 80. A slave piston 82 is positioned for reciprocating movement within the cyliner 76. One end of the slave piston 82 is adapted to contact the exhaust valve stem cap 84 while the opposite end of the slave piston contacts an adjustable timing mechanism 86 which is threaded into the engine brake housing 10 in alignment with the slave piston 82 and locked in position by locknut 88. A slave piston return spring 77 is located within the slave piston 82 so that one end of the spring biases the slave piston upwardly against the timing mechanism 86. The opposite end of the spring 77 is carried by a retainer 79 seated in the engine brake housing. The slave cylinder 76 contains an outlet port 90 which communicates with the inlet port 92 of a master cylinder 94 formed in the engine brake housing 10 through a duct 96. A master piston 98 is mounted for reciprocating motion in the master cylinder 94 and its outer end is adapted to contact the rocker arm adjusting screw 100 of the appropriate fuel injector or intake valve rocker arm 102 which, in turn, is actuated by the pushrod 104. The master piston 98 is held in the housing bore by a light leaf spring 106.

It will be understood that, ordinarily, there will be a slave piston 82 associated with each exhaust valve so that a six cylinder engine will have six slave pistons while a four cylinder engine will have four slave pistons. In addition, each slave piston is interconnected with a master piston associated with an intake or fuel injector rocker arm and pushrod. Of course, the master and its related slave piston may be associated with different engine cylinders. An exemplary relationship for this alternative is shown in Table 1 below for a six cylinder engine:

TABLE 1

| Location of Master Piston | Location of Slave Piston |
|---|---|
| No. 1 Pushrod | No. 3 Exhaust Valve |
| No. 5 Pushrod | No. 6 Exhaust Valve |
| No. 3 Pushrod | No. 2 Exhaust Valve |
| No. 6 Pushrod | No. 4 Exhaust Valve |
| No. 2 Pushrod | No. 1 Exhaust Valve |
| No. 4 Pushrod | No. 5 Exhaust Valve |

It will be understood that when the solenoid valve 20 is opened, oil 14 flows through the solenoid valve and control valve 54 and fills the ducts 72 and 96 as well as the slave cylinder 76 and master cylinder 94. Check valve 64 prevents a reverse flow of oil 14 from the slave and master cylinders. Thereafter, activation of the pushrod 104 will move the master piston 98 upwardly in the master cylinder 94 causing a rapid rise in the pressure of the oil. The hydraulic pressure in the slave cylinder 76 will force the slave piston 82 downwardly so as to open the exhaust valve 78.

It will be appreciated that if the slave piston 82 is not seated against the exhaust valve stem cap 84 when the master piston 98 begins to move, the opening of the exhaust valve 78 will be delayed by the time required to take up the clearance in the system. However, it is necessary to accommodate dimensional changes in the mechanism, such as the exhaust valve stem, due to temperature changes. In the prior art device, the clearance was controlled by an adjusting screw located in the position of the timing mechanism 86 and set to a clearance of, for example, 0.018 inch when the engine was cold. In accordance with the present invention, a timing mechanism 86 is provided which effectively maintains a denied clearance in the exhaust valve actuating mechanism, which clearance may be positive, zero, or negative. In the event of zero or negative clearance, movement of the exhaust valve will begin as soon as the master piston begins to move whenever the brake mechanism is operated.

Referring now to FIGS. 2 and 3, the timing mechanism 86 comprises an adjustable body 108 having threads formed on its external cylindrical surface which is threadably engaged with the engine brake housing 10 in alignment with the slave cylinder 76. The body 108 may be provided with a slot 110 or other appropriate recess for convenience of adjustment and may be locked in the desired position by a locknut 88. While the timing mechanism 86 may be located elsewhere, for example, between the slave piston 82 and exhaust valve stem cap 84, or within the slave piston, it is preferable for purposes of convenient adjustability to position one end of the mechanism exteriorly of the exhaust valve mechanism.

A series of three coaxial bores 112, 114 and 116 are formed in the body 108 extending partially through the body 108 from the end opposite that containing the adjusting slot 110. The first, and largest, bore 112 extends approximately halfway through the body 108 and is adapted to receive a timing piston 118. The intermediate bore 114 extends approximately halfway through the remaining length of the body 108 and contains therein a compression spring 120. The third and smallest bore 116 extends slightly deeper than the intermediate bore 114 to provide a seat for check valve spring 122. It will be understood, of course, that a single bore having the diameter of bore 112 and the depth of bore 116 may be used in place of the three bores shown and described above.

The timing piston 118 is formed with an axial bore 124 extending entirely through the piston 118. At the inner or upper end of the piston an enlarged bore 126 is formed to provide a seat 128 for a ball check valve 130. The ball check valve 130 is normally urged against the seat 128 by the compression spring 122. A transverse bore or slot 132 is formed across a diameter of the piston 118. The body 108 contains a transverse bore 134 within which is pressed a pin 136. The bore or slot 132 is substantially wider than the pin 136 so as to permit the piston 118 to move axially relative to the body 108 within a limited range. In the present embodiment, the range of movement of the piston 118 is from a first position very slightly within the body 108 to a second position wherein the piston 118 extends slightly beyond the end of the body 108, for example, 0.010–0.028 inches.

It will be appreciated that the compression spring 120 normally urges the piston 118 to its extended position while the lighter, i.e., lower rate, compression spring 122 urges the ball check valve to a closed position.

While it is convenient to use a ball check valve 130 and compression spring 122, it will be understood that other check valve means may be employed. For example, a leaf valve or other form of check valve may be located either on the timing piston 118 or in a separate duct communicating between the slave cylinder 76 and the region of the bores 112, 114, 116 above the timing mechanism piston 118. Similarly, means other than the pin 136 and slot 132 may be employed to provide limited axial movement of the piston 118 within the adjustable body 108. Such alternate means may include a reduced diameter at the lower end of the piston 118 and a mating inwardly directed flange or lip on the lower end of the adjustable body 108.

The operation of the mechanism will now be described. First, the adjustable body 108 may be set to provide any desired clearance, for example, 0.018 inch between the slave piston 82 and the exhaust valve stem cap 84 to insure that, under all operating conditions, there will be sufficient clearance to prevent unintentional partial opening or lifting of the exhaust valve 78. Under these conditions, the timing mechanism piston 118 will be retracted very slightly into the body 108 and the body 108 will be in direct contact with the top of the slave piston 82.

When it is desired to operate the engine brake, the solenoid valve 20 and the control valve 54 are actuated. This results in a flow of oil 14 through the ducts 72 and 96 and into the slave cylinder 76 and master cylinder 94. When the master piston 98 begins to move, pressure is immediately built up in the hydraulic circuit as that circuit has been fully filled with oil 14. Thus, the movement of the master piston 98 will immediately result in movement of the slave piston 82 and, after clearance in the mechanism has been taken up, opening of the exhaust valve with which the slave piston is associated.

As the slave piston 82 moves away from the timing mechanism body 108, the timing mechanism piston 118 extends due to force from compression spring 120. This creates a pressure differential sufficient to cause the ball check valve 130 to unseat and admit oil to the region of the bores 112, 114 and 116. Upon return of the slave piston 82 to its initial position, it encounters the timing mechanism piston 118. The oil which has entered the timing mechanism through the check valve 130 is trapped, and being relatively incompressible, will oppose the force applied to the slave piston 82 by the slave return spring 77. Thus, the slave piston 82 assumes a new initial position for all subsequent operating cycles, determined essentially by the predetermined stroke of the timing mechanism piston 118. Any leakage between the piston 118 and the bore 112 is automatically replaced through the ball check valve 130 during the following operating cycle.

When the engine brake solenoid valve 20 and control valve 54 are deactivated, the hydraulic circuit is vented to drain. As the cyclic motion of the slave piston 82 ceases and it comes to rest on the timing mechanism piston 118, leakage past the piston to bore clearance will permit full retraction of the timing mechanism piston and relocation of the slave piston to its original position against adjusting screw body 108.

The result of effectively eliminating clearance or backlash in the valve actuating mechanism is demonstrated in FIG. 4. FIG. 4 is a graph showing the relationship between engine speed and absorbed or braking power for a six cylinder and a four cylinder engine with and without the timing mechanism of the present invention. Curve 138 is a plot of the braking horsepower obtained from a six cylinder diesel engin fitted with a Jacobs engine brake and having the clearance adjustment set at 0.018 inch in accordance with the prior art. Curve 140 is a plot of the braking horsepower obtained from the same engine wherein the clearance adjusting screw was replaced with a timing advance mechanism in accordance with the present invention. In a similar manner curve 142 is a plot of the braking horsepower developed by a four cylinder diesel engine equipped with a standard Jacobs engine brake while curve 144 shows the effect of substituting the timing advance mechanism of the present invention for a standard adjusting screw set for a clearance of 0.018 inch. It will be observed that at normal engine operating speeds in the range of 2000 r.p.m., a very substantial increase in retarding horsepower is attained by the practice of the present invention.

As indicated schematically in FIG. 1, the engine brake of the present invention is operated by a solenoid valve which is wired in series with three switches, a fuel pump switch 42, a clutch switch 44 and a dash switch 46. It will be appreciated that if any one or more of these switches is in the open position, the brake cannot be operated. The fuel pump switch 42 disables the brake system whenever the enginee is being fueled, i.e., whenever the throttle is opened. The clutch switch 44 opens whenever the clutch is disengaged in order to prevent stalling of the engine. The dash switch 46 is a manual control to enable the operator to disengage the brake system if he should wish to do so. The dash switch 46 may also be of the multi-position type which deactivates a portion of the system so that the operator can select partial or full braking power as may be desired under particular operating conditions.

In addition to the primary advantage of substantially increasing the braking horsepower of the engine as shown by FIG. 4, the timing advance mechanism of the present invention can be retrofitted on engines having engine brakes of the type herein disclosed without requiring any modification of the engine. A secondary advantage of the timing advance mechanism here disclosed is a decrease in the pushrod loading when the device is employed in an engine having mechanical fuel injectors operated from pushrods. This advantage results from the increase in the time interval between the opening of the exhaust valve and the actuation of the fuel injector. Applicant has found that for each 0.001 inch decrease in clearance the pushrod load is decreased by about 50 pounds in engines of the character tested for FIG. 4.

Up to this point, the present invention has been described with respect to an embodiment wherein the normal exhaust valve operating mechanism clearance is effectively reduced to zero during the braking mode of operation. In such an embodiment, if the normal cold clearance is 0.018 inch, the timing mechanism is designed so that the piston 118 extends outwardly, during operation, a distance of 0.018 inch from the end of the body 108. This may be accomplished by controlling the width of the slot 132 to permit the desired extension of 0.018 inch.

It will be appreciated that by an appropriate change in the width of the slot 132, the motion of the piston 118 may be increased or decreased. Thus, if it were desired to provide a small positive clearance of, for example, 0.005 inch during braking in an engine having a clearance when cold of 0.018 inch in the fueling mode, the extension of the piston 118 would be designed to be 0.013 inch. Similarly, if it were desired to provide a small negative clearance of, for example, 0.005 inch during braking in an engine having a clearance when cold of 0.018 inch in the fueling mode, the extension of the piston 118 would be designed to be 0.023 inch.

The foregoing examples are, of course, merely illustrative of the principle involved because, in each case, consideration must be given to the actual exhaust valve clearance during normal engine operation, which clearance depends upon the design of the particular engine involved and the conditions under which it is operated. Once these factors are established or specified, the timing mechanism according to the present invention can be designed to give the desired braking clearance which may be positive, negative, or essentially zero. It will be understood that a number of timing mechanisms may be supplied to provide a number of standard extensions so that the engine owner may select the appropriate timing device to optimize the braking operation of his particular engine.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. In an engine braking system of a gas compression release type including a combustion engine having exhaust valve means, hydraulically actuated reciprocating first piston means associated with said exhaust valve means to open said exhaust valve means at a predetermined time, and means for applying hydraulic pressure fluid to one end of said first piston means, the improvement comprising a timing means including body means adjustably positioned within said engine so as to locate one end of said body means to provide a first predetermined clearance in said exhaust valve means when said first piston means is in contact with said body means and said exhaust valve means are in a fully closed position, said body means having a cavity formed therein, second piston means having first and second ends and closely fitted for reciprocating movement with respect to said cavity of said body means between a first position in which said second piston means is located entirely within said cavity and a second position in which said second end of said second piston means extends outwardly a predetermined distance from said one end of said body means, said first end of said second piston means defining a closure for said cavity in said body means, said second end of said second piston means adapted to provide, in its second position, a second predetermined clearance in said exhaust valve means whenever said means for applying hydraulic pressure fluid is actuated, check valve means communicating between said cavity of said body means and said one end of said body means whereby said hydraulic fluid is directed into said cavity whenever the hydraulic pressure on said first piston exceeds the hydralic pressure in said cavity and spring means biasing said second piston means toward said one end of said body means.

2. An apparatus as described in claim 1 in which said check valve means comprises a ball check valve, said second piston means having an axial duct formed therethrough and a valve seat formed at one end of said duct, and spring means biasing said ball check valve against said valve seat.

3. An apparatus as described in claim 1, wherein said second predetermined clearance in said exhaust valve means is smaller than said first predetermined clearance but no less than zero.

4. An apparatus as described in claim 2, wherein said second predetermined clearance in said exhaust valve means is smaller than said first predetermined clearance but no less than zero.

5. An apparatus as described in claim 1, wherein said second predetermined clearance in said exhaust valve means is negative whereby when said means for applying hydraulic pressure fluid is actuated, said exhaust valve means are maintained in a partially open position.

6. An apparatus as described in claim 2, wherein said second predetermined clearance in said exhaust valve means is negative whereby when said means for applying hydraulic pressure fluid is actuated, said exhaust valve means are maintained in a partially open position.

7. In an engine braking system of a gas compression relief type including a combustion engine having exhaust valve means, hydraulically actuated reciprocating first piston means associated with said exhaust valve means to open said exhaust valve means at a predetermined time, and means for applying hydraulic pressure fluid to one end of said first piston means, the improvement comprising a timing means, including body means adjustably positioned within said engine so as to locate one end of said body means to provide a first predetermined clearance in said exhaust valve means when said first piston means is in contact with said body means and said exhaust valve means are in a fully closed position, said body means having a cavity formed therein, pin means fixed to said body means transversely across the said cavity of said body means, second piston means having first and second ends and closely fitted for reciprocating movement with respect to said cavity of said body means between a first position in which said second piston means is located entirely within said cavity and a second position in which said second end of said second piston means extends outwardly a predetermined distance from said one end of said body means, said second piston means having formed transversely therethrough a slot having a width in the axial direction of said second piston means greater than the axial dimension of said pin means so as to define said first and second positions of said second piston means, said first end of said second piston means defining a closure for said cavity in said body means, said second end of said second piston means adapted to provide, in its second position, a second predetermined clearance in said exhaust valve means whenever said means for applying hydraulic pressure fluid is actuated, check valve means communicating between said cavity of said body means and said one end of said body means whereby said hydraulic fluid is directed into said cavity whenever the hydraulic pressure on said first piston exceeds the hydraulic pressure in said cavity and spring means biasing said second piston means toward said one end of said body means.

8. An apparatus as described in claim 7 in which said check valve means comprises a ball check valve, said second piston means having an axial duct formed therethrough and a valve seat formed at one end of said duct, and spring means biasing said ball check valve against said valve seat.

9. An apparatus as described in claim 7, wherein said second predetermined clearance in said exhaust valve means is smaller than said first predetermined clearance but no less than zero.

10. An apparatus as described in claim 8, wherein said second predetermined clearance in said exhaust valve means is smaller than said first predetermined clearance but no less than zero.

11. An apparatus as described in claim 7, wherein said second predetermined clearance in said exhaust valve means is negative whereby when said means for applying hydraulic pressure fluid is actuated, said exhaust valve means are maintained in a partially open position.

12. An apparatus as described in claim 8, wherein said second predetermined clearance in said exhaust valve means is negative whereby when said means for applying hydraulic pressure fluid is actuated, said exhaust valve means are maintained in a partially open position.

* * * * *